US007471259B2

(12) United States Patent
Wrathall et al.

(10) Patent No.: US 7,471,259 B2
(45) Date of Patent: Dec. 30, 2008

(54) TANK ANTENNA

(75) Inventors: Paul Wrathall, Musquodoboit (CA); Colin Frame, Fall River (CA)

(73) Assignee: Ultra Electronics Canada Defence Inc., Dartmouth, Nova Scotia ( * ) Notice: Subject to any disclaimer, the term of this patent is extended or adjusted under 35 U.S.C. 154(b) by 153 days.

(21) Appl. No.: 11/678,470

(22) Filed: Feb. 23, 2007

(65) Prior Publication Data

US 2008/0204335 A1 Aug. 28, 2008

(51) Int. Cl.
*H01Q 1/36* (2006.01)

(52) U.S. Cl. ..... 343/895; 343/873; 343/788; 128/204.23

(58) Field of Classification Search ..... 343/719, 343/787, 788, 873, 895; 128/204.23
See application file for complete search history.

(56) References Cited

U.S. PATENT DOCUMENTS 6,002,377 A * 12/1999 Huynh et al. ..... 343/895
6,199,550 B1 * 3/2001 Wiesmann et al. ..... 128/204.23
6,333,723 B1 12/2001 Locke
6,447,115 B1 * 9/2002 Gallagher et al. ..... 351/43
6,606,993 B1 * 8/2003 Wiesmann et al. ..... 128/204.23
6,959,456 B2 * 11/2005 Boettcher et al. ..... 2/457
7,414,591 B1 * 8/2008 Lier et al. ..... 343/895
2003/0169208 A1 * 9/2003 Wu ..... 343/895

* cited by examiner

*Primary Examiner*—Tan Ho
(74) *Attorney, Agent, or Firm*—Novak Druce + Quigg, LLP

(57) ABSTRACT

An air tank for a self-contained breathing apparatus that incorporates a coil antenna for use in a magneto-inductive system. The coil antenna is formed as a part of the tank. The antenna is embedded within the sidewall of the air cylinder to form the air tank. The self-contained breathing apparatus may include a magneto-inductive device operatively connected to the coil antenna for conducting magneto-inductive communications. A microphone and speaker or headset may be included to facilitate voice communications over the magneto-inductive system.

18 Claims, 3 Drawing Sheets

TANK ANTENNA

FIELD OF THE INVENTION

The present invention relates to antennas and, in particular, to a coil antenna.

BACKGROUND OF THE INVENTION

Wireless electronic communications encounter particular difficulties in certain types of environments or situations. In urban environments, reflections and multi-path are problematic. In underwater or underground environments, signal attenuation presents a particular problem for RF signals. In military applications, signal interception and signal jamming are significant concerns with RF communications.

Accordingly, wireless communications systems have been developed that rely upon magneto-inductive technology. Magneto-inductive communications use quasi-static low frequency AC magnetic fields. A quasi-static magnetic field differs from an electromagnetic field in that the electric field component is negligibly small. A quasi-static magnetic field does not propagate as an electromagnetic wave, but instead arises through induction. Accordingly, a quasi-static magnetic field is not subject to the same problems of reflection, refraction or scattering that radio frequency electromagnetic waves suffer from, and may thus communicate through various media (e.g. earth, air, water, ice, etc.) or medium boundaries. It is also very difficult to intercept or eavesdrop on magneto-inductive communications since interception would require an antenna properly tuned to the specific magnetic field.

Typical magneto-inductive (MI) systems include a magneto-inductive transmitter and a magneto-inductive receiver, and operate in the range of a few hundred Hz to 10 kHz. More typically, the operating frequency of an MI system is in the range of 500 to 3000 Hz. The MI transmitter and the MI receiver each have a coil antenna. In some cases, the antenna may be single loop of wire. In others, the antenna may be a helical coil of wire with multiple turns. Some MI systems may be capable of two-way communication and, thus, may feature MI transceivers. The MI transceiver may use a single antenna for both transmission and reception; although it may be advantageous in some instances to have a different loop length for transmission and reception. Accordingly, in some instances, the MI transceiver may have two separate antennas or may have a single switchable antenna that is capable of altering its length depending on whether it is used in transmit or receive mode. An example of a switchable antenna is described in U.S. Pat. No. 6,333,723, entitled Switchable Transceiver Antenna, and owned in common herewith.

MI systems find application in undersea operations, mining, military, and other such fields. For example, MI systems may be used for wireless communications purposes, including, in some cases, the transmission of data communications or the transmission of audio for voice communications.

The robustness of MI communications and the resistance of the signal to interference, reflection, refraction, and other environmental attenuations make them particularly attractive for enabling communications in the mining industry, in emergency services, in military applications, and similar hazardous environments.

A difficulty arises in providing for an MI system that is easily portable by personnel. Emergency service personnel, military personnel, and the like, are already burdened with heavy equipment, so it would be advantageous to minimize the bulk and cumbersomeness associated with carrying a portable MI transceiver.

SUMMARY OF THE INVENTION

The present application provides a solution that partially incorporates the MI transceiver into existing equipment borne by the user. In particular, the MI antenna is formed as a part of a wearable tank. Wearable tanks are typically used by such personnel in a self-contained breathing apparatus. The form of an air tank lends itself to incorporating a helical coil antenna, as may be used in a typical MI system.

In one aspect, the present application describes a wearable tank for use in a self-contained breathing apparatus and with a portable magneto-inductive device. The magneto-inductive device has a magneto-inductive transceiver, a controller, and a power source. The tank includes a hollow cylinder for containing gas and having an opening adapted for connection to an air hose of the self-contained breathing apparatus. The cylinder has a center axis and has a sidewall with an inner surface defining the interior of the hollow cylinder. The hollow cylinder is formed from a non-conductive material. The tank also includes an antenna formed from a helical coil of wire wound around the center axis and disposed within the sidewall.

In another aspect, the present application provides self-contained breathing apparatus (SCBA). The SCBA includes an air tank, a pressure regulator, a mask, and hoses interconnecting the air tank, the pressure regulator and the mask to supply the mask with air from the air tank regulated by the pressure regulator. The tank includes a hollow cylinder for containing gas and having an opening adapted for connection to one of the hoses. The cylinder has a center axis and has a sidewall with an inner surface defining the interior of the hollow cylinder. The hollow cylinder is formed from a non-conductive material. The tank includes an antenna formed from a helical coil of wire wound around the center axis and disposed within the sidewall.

Other aspects and features of the present application will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present application, and in which.

Similar reference numerals are used in different figures to denote similar components.

DESCRIPTION OF SPECIFIC EMBODIMENTS

Personnel that work in hazardous environments, such as emergency services or mining, are often equipped with a self-contained breathing apparatus (SCBA). An SCBA is a portable system for supplying the wearer with a breathable air supply. It typically includes an air tank, a pressure regulator, and a mask. The mask may include, for example, a simple mouthpiece, a mouth-and-nose mask, or a full face mask. The air tank or cylinder is filled with a pressurized gas, typically air.

An SCBA often includes a harness or frame that allows a user to strap the tank onto himself. The harness typically includes shoulder straps and a waist strap, and secures the tank to the user's back. The cylinder is typically positioned such that the open end or valve of the cylinder is at the bottom when worn by the user; however this is not strictly necessary.

Because the personnel equipped with SCBAs are already burdened with heavy equipment, the present application provides an SCBA tank that incorporates an MI antenna. This avoids encumbering the user with additional equipment, aside from the MI transceiver device itself, while taking advantage of existing real-estate on standard equipment.

Figure 1:
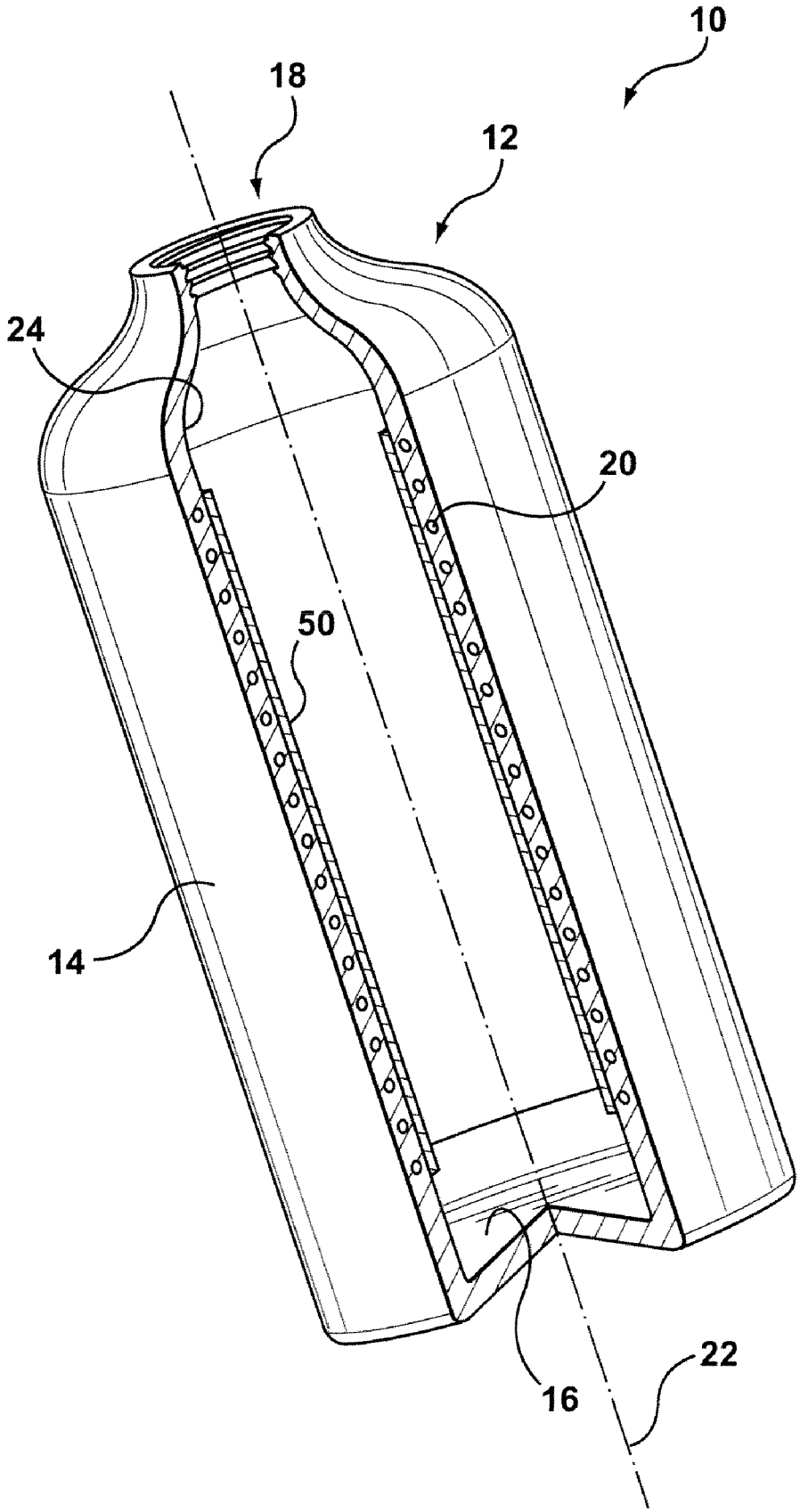
FIG. 1 shows a partial sectional view of an embodiment of an air tank, which includes a cylinder and an antenna.

Reference is first made to FIG. 1, which shows a partial sectional view of an embodiment of an air tank 10.

The tank 10 includes a hollow cylinder 12 for containing a pressurized gas. The hollow cylinder 12 includes a sidewall 14, an end wall 16, and a valve opening 18. The valve opening 18 may include a threaded coupling for securing a cylinder valve (not shown) to control the flow of gas into or out of the cylinder. The sidewall 14 has an inner surface 24 partly defining the interior of the hollow cylinder 12. The cylinder 12 has a longitudinal center axis 22.

The cylinder 12 may be of any size or shape; however, in many embodiments, the size and shape of the cylinder 12 is typical of air cylinders used in standard SCBA or SCUBA equipment.

The cylinder 12 is formed from a non-conductive material. For example, in one embodiment, the cylinder 12 is manufactured from fiber-reinforced plastic. For example, the cylinder 12 may be formed from fiberglass. Other materials may also be used, provided they are non-conductive and have sufficient structural integrity to contain pressurized gas suitable for a given operating environment.

Figure 2:
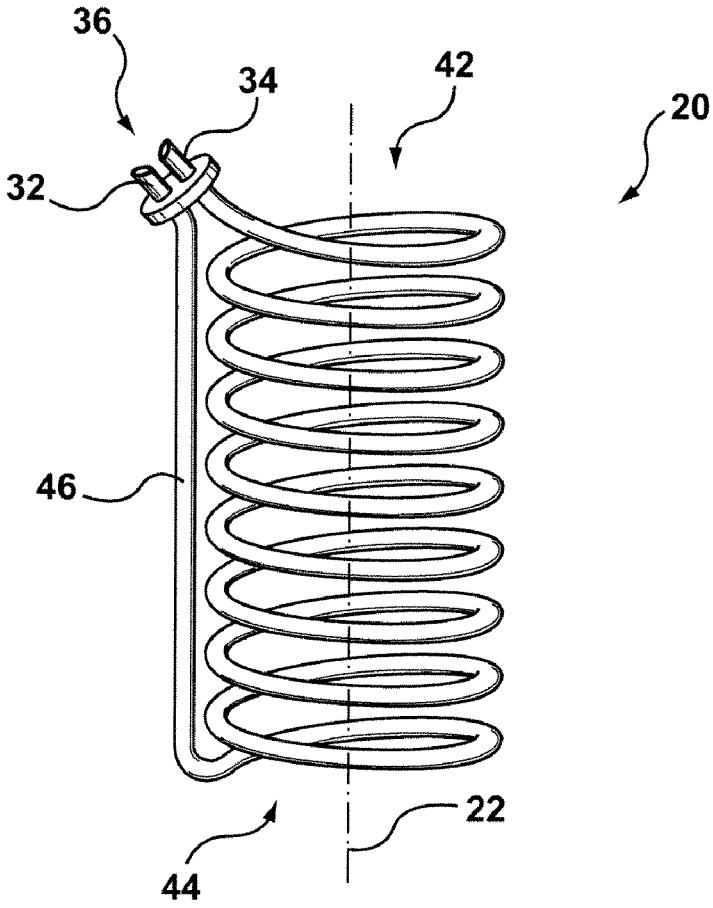
FIG. 2 shows a side view of the antenna without the cylinder.

The tank 10 includes an antenna 20. The antenna 20 is a coil of wire. In one embodiment, the antenna 20 includes a single turn or loop of the wire; however, in many embodiments, the antenna 20 includes multiple turns of the wire, forming a helix. Reference is now also made to FIG. 2, which shows a side view of the antenna 20 without the cylinder 12.

In one embodiment, the coil of wire forming the antenna 20 is formed from multiple bundles of wire. The ends of the various bundles may be connected to a switching module (not shown), as described in U.S. Pat. No. 6,333,723, entitled Switchable Transceiver Antenna, and owned in common herewith. The contents of U.S. Pat. No. 6,333,723, are hereby incorporated by reference. References herein to the coil of wire will be understood to include a coil of a single wire or a coil formed from more than one wire.

The antenna 20 is embedded or encased within the sidewall 14 of the cylinder 12. The antenna 20 is formed from conductive material, such as a metal. In one embodiment, the antenna 20 is formed from copper wire, however other conductive materials may be used.

The ends of the wire that forms the antenna 20, indicated with reference numerals 32 and 34, may be routed to a common point at which a connector 36 may be formed. The common point for the connector 36 may be situated at the outer surface of the tank to facilitate connection with cabling or wiring from an MI transceiver unit, which may be worn or carried by the user. The connector 36 may be of any type suitable for the application. The connector 36 may be detachable from a corresponding connector on the cabling or wiring, for example through a push-fit or snap-fit engagement mechanism. The various alternatives will be understood by those skilled in the art.

In one embodiment, the antenna 20 is coiled in a helix as shown in FIG. 2 and the coil of wire forming the antenna 20 is centered on the longitudinal axis 22. The antenna 20 has a first loop 42 and a last loop 44. To route the ends 32, 34 of the wire to a common point, a portion 46 of one of the ends 32, 34 of the wire forming the antenna 20 is disposed parallel to the longitudinal axis 22 and runs along the inside or outside (as shown in FIG. 2) of the coil of wire. The portion 46 of wire extends from, for example, the last loop 44 to the connector 36. The portion 46 of wire is also embedded or encased within the sidewall 14 of the cylinder 12.

In one embodiment, the sidewall 14 of the cylinder 12 includes a magnetically permeable material 50 disposed on its inner surface. The magnetically permeable material 50 may increase or improve the magnetic flux of the antenna 20. In one embodiment, the magnetically permeable material 50 may be a ferrite, i.e. an electrically non-conductive ferrimagnetic ceramic compound. Ferrite is often formed from a mixed powder through a sintering process. In some instances, appropriate ferrite materials may be found in magnetic alloys available in amorphous strips, such as, by way of example, magnetic alloys marketed by Metglas, Inc. of Conway, S.C., USA. Those skilled in the art will appreciate the range of magnetically permeable materials that may be used.

The magnetically permeable material 50 need not cover the entire interior of the cylinder 12. In one embodiment, the magnetically permeable material 50 is disposed only on that portion of the sidewall 14 containing the antenna 20. In other words, the magnetically permeable material 50 forms a tube within the coil of wire that makes up the antenna 20.

In one embodiment, the magnetically permeable material 50 may be partly or wholly embedded or encased within the sidewall 14. For example, the magnetically permeable material 50 may be covered with an inner layer of fiberglass, which then defines the interior diameter of the cylinder 12. In another example, the inner surface may be sealed with a coating material, such as a plastic or a suitable resin. If the magnetically permeable material 50 is a ferrite, sealing of the magnetically permeable material 50 may be desirable since ferrites tend to be brittle and any deterioration in the material 50 could lead to ferrite particles within the cylinder 12, and thus, may pose a breathing hazard.

Figure 3:
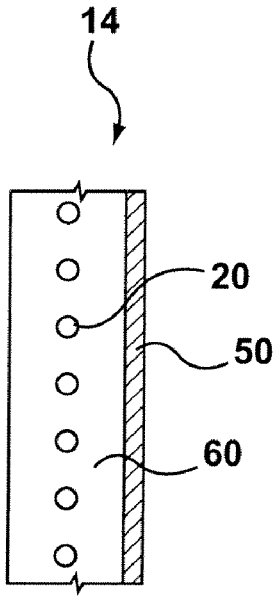
FIG. 3 shows a partial cross-sectional view of an embodiment of the sidewall of the tank.

Reference is now made to FIG. 3, which shows a partial cross-sectional view of an embodiment of the sidewall 14 of the tank 10. In this embodiment, the antenna 20 coil windings are encased within the material forming sidewall 14. For example, the antenna 20 coil structure may be formed and a fiber-reinforced material 60 forming the cylinder 12 may be cured or molded around the antenna 20. In some embodiments, the antenna 20 structure may provide rigidity or reinforcement to the structural integrity of the cylinder 12. The magnetically permeable material 50 may be deposited or formed on the inner surface of the fiber-reinforced material 60.

Figure 4:
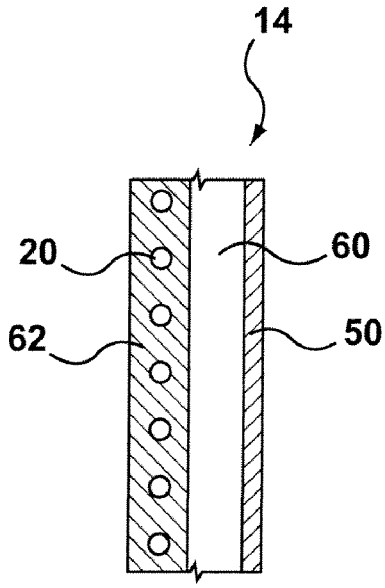
FIG. 4 shows a partial cross-sectional view of another embodiment of the sidewall of the tank.

A partial cross-sectional view of another embodiment of the sidewall 14 of the tank 10 is shown in FIG. 4. In this embodiment, the cylinder 12 is formed from the fiber-reinforced material 60, for example through a molding process. The antenna 20 is then formed through winding the coil of wire around the cylinder 12. An exterior layer of a non-conductive material 62 is then formed or cured atop the antenna 20 to encase the antenna 20 in the non-conductive material 62. The non-conductive material 62, may, in some embodiments, by the same material as the fiber-reinforced material 60. Suitable resins or bonding materials may be applied to the exterior surface of the fiber-reinforced material 60 prior to forming the antenna 20 or applying the layer of non-conductive material 62 to ensure bonding of the various elements and sufficient strength and rigidity in the tank 10. The magnetically permeable material 50 may be deposited or formed on the inner surface of the fiber-reinforced material 60.

Figure 5:
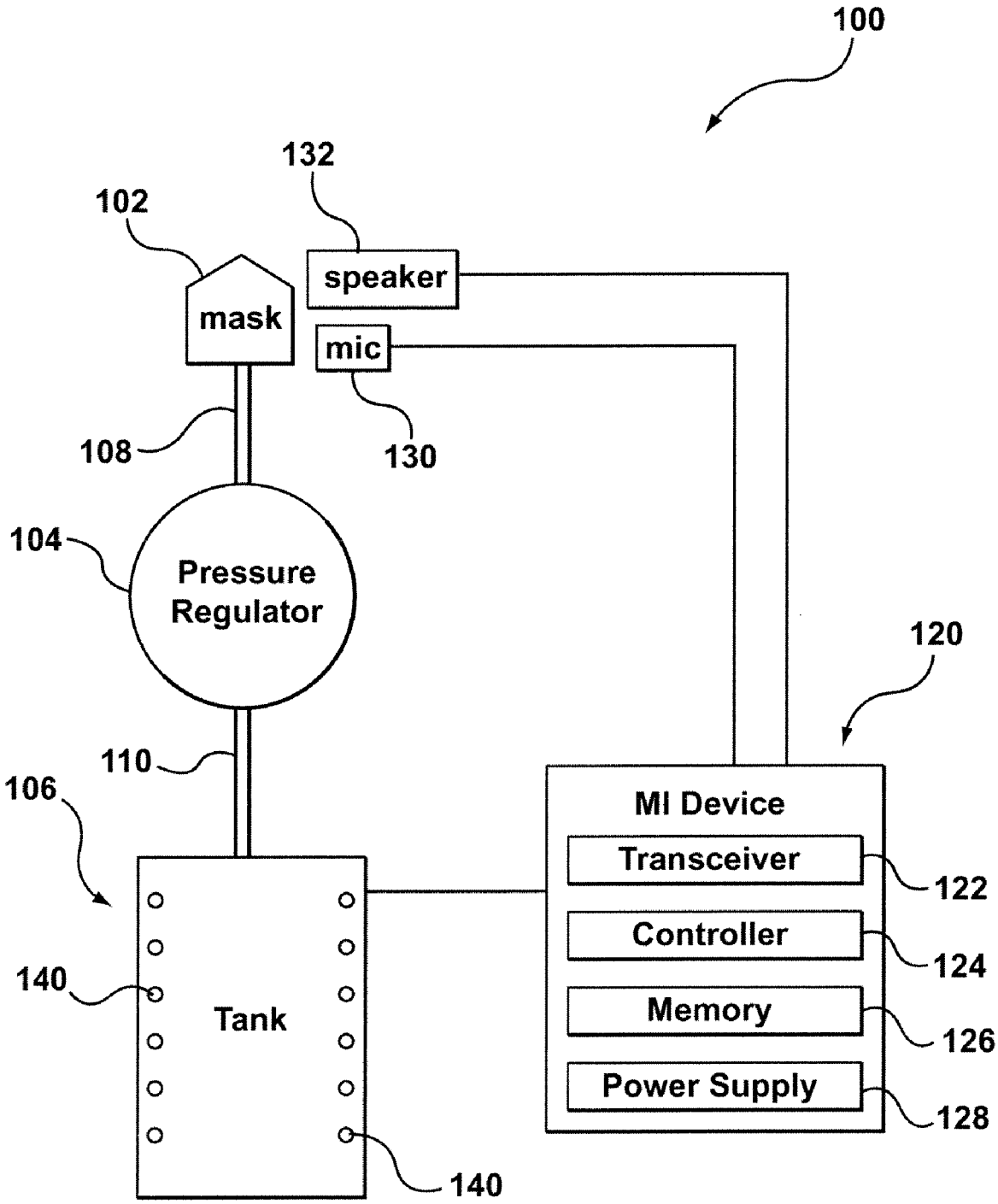
FIG. 5 shows, in block diagram form, an example of a self-contained breathing apparatus (SCBA) with MI communications capability.

Reference is now made to FIG. 5, which shows, in block diagram form, an example of a self-contained breathing apparatus (SCBA) 100 with MI communications capability.

The SCBA 100 includes a mask 102, a pressure regulator 104 and an air tank 106. The mask 102, regulator 104 and air tank 106 are connected via air hoses 108, 110, as is known in the art. The air tank 106 may be mounted to a harness or frame such that it can be worn by a user. Typically, the harness or frame straps the tank 106 to the user's back. The mask 102 may be a mouthpiece, partial facemask, full facemask, or any other configuration for supplying air to the user's nose and/or mouth.

The air tank 106 includes a hollow cylinder and a coil antenna 140 integrated into the sidewall of the cylinder, as described above.

The SCBA 100 further includes an MI device 120 configured to receive or transmit MI signals via the antenna 140. The MI device 120 includes a transceiver module 122 connected to the antenna 140 for receiving and demodulating signals induced in the antenna 140. The transceiver module 122 may also generate MI signals for exciting the antenna 140 so as to generate a quasi-static MI field for transmitting modulated data signals.

The MI device 120 also includes a controller 124 for controlling the transceiver module 122 and the overall functionality of the MI device 120. The controller 124 may be a suitably programmed microprocessor, microcontroller, application-specific integrated circuit, or other software-based device. The MI device 120 may further include memory 126 and a power source 128, such as a battery.

The MI device 120 may be attached to the same harness or frame supporting the other SCBA equipment, like the air tank 106. The MI device 120 may also be strapped to or worn by the user by way of a separate attachment mechanism. For example, the MI device 120 may be strapped to the user's belt or incorporated into the user's battledress or other wearable items.

The MI device 120 may, in one embodiment, be configured to permit voice communications. The voice communications may be one-way, intended only for reception or transmission. In another embodiment, the voice communications may be two-way, intended to permit conversation with a remote user similarly equipped with an MI-enabled SCBA or with an MI base station. The MI device 120 may include one or more analog audio output ports for outputting audio received or inputting speech from the user. The output port may be connected to a speaker 132 and the input port may be connected to a microphone 130. In one embodiment, the microphone 130 and/or speaker 132 may be incorporated into a headset intended to be worn by the user. The microphone 130 and/or speaker may be incorporated into the mask 102.

The MI device 120 may permit half duplex communications. Accordingly, the MI device 120 may include an input device, such as a button or other trigger, that is to be activated by the user when the user wishes to transmit his or her voice, i.e. a push-to-talk architecture. In another embodiment, the MI device 120 may include a voice detection module for determining whether the user is speaking and/or whether input speech signals are being received through MI signals induced in the antenna 140. Outgoing speech transmission may only be permitted when incoming transmissions are not detected.

In other embodiments, the MI device 120 may be configured for communications other than, or in addition to, voice. For example, the MI device 120 may be configured for data communications to or from a base station or to or from other MI-enabled SCBA devices.

The design and operation of the MI device 120, and MI communications in general, will be familiar to those ordinarily skilled in the art.

Although the SCBA 100 is described above as including a transceiver module 122 within the MI device 120, it will be appreciated that in some embodiments the MI device 120 may contain a separate receiver module and/or transmitter module. For example, in an embodiment in which the MI device 120 is designed solely to receive signals, the transceiver module 122 may be replaced with a receiver module. Similarly, if the MI device 120 is designed to solely to transmit signals, the transceiver module 122 may be replaced with a transmitter module. In yet another embodiment, both a separate transmitter and receiver module are incorporated into the MI device 120.

In one example, the MI device 120 may be designed as a receive-only device. In one embodiment, it is used to enable receipt of commands, instructions, data, etc., from a base station. In another example, the MI device 120 may be designed as a transmit-only device. For example, the MI device 120 may emit an MI beacon or distress signal. The MI beacon or distress signal may be used by two or more basestations or other MI-enabled portable receivers to triangulate and locate the SCBA 100. Alternatively, a portable MI receiver device may be equipped with a tri-axis antenna permitting the receiver to identify the direction of origin of the MI beacon signal and, thereby, locate the SCBA 100.

In yet another example embodiment, the MI device 120 may emit a beacon signal and be enabled for other communications functions. For example, the beacon signal may be broadcast by the MI device 120 on a first frequency and the other communications functions, such as voice and/or data, may take place on a second frequency, where the second frequency is likely higher than the first frequency to permit greater bandwidth. The lower beacon frequency provides greater range, which would be desirable in the case of an emergency beacon.

Certain adaptations and modifications of the invention will be obvious to those skilled in the art when considered in light of this description. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A wearable tank for use in a self-contained breathing apparatus and with a portable magneto-inductive device, the magneto-inductive device having a magneto-inductive transceiver, a controller, and a power source, the tank comprising:

a hollow cylinder for containing gas and having an opening adapted for connection to an air hose of the self-contained breathing apparatus, the cylinder having a center axis and having a sidewall with an inner surface defining the interior of the hollow cylinder, the hollow cylinder being formed from a non-conductive material; and an antenna formed from a helical coil of wire wound around said center axis and disposed within said sidewall.

2. The tank claimed in claim 1, wherein said sidewall includes an outer surface defining an exterior side of said cylinder, and wherein the antenna is embedded within said sidewall between said inner surface and said outer surface.

3. The tank claimed in claim 1, wherein at least a portion of said inner surface includes a layer of magnetically permeable material.

4. The tank claimed in claim 3, wherein said magnetically permeable material comprises a ferrite or magnetic alloy.

5. The tank claimed in claim 1, wherein said sidewall comprises a first inner sidewall around which said antenna is wound during manufacture, and a second outer sidewall molded around said antenna and bonded to said inner sidewall.

6. The tank claimed in claim 1, wherein said antenna is formed by said coil of wire in a helical configuration and said sidewall is formed by molding said non-conducive material around said antenna.

7. The tank claimed in claim 1, wherein said magneto-inductive transceiver includes an antenna port for connecting with said antenna, and wherein said coil of wire includes ends co-located at an exterior surface of said tank and configured as an antenna connector for connection to said antenna port.

8. The tank claimed in claim 1, wherein said non-conductive material comprises fibre-reinforced plastic.

9. The tank claimed in claim 1, wherein said coil of wire comprises multiple strands of wire bundled and coiled in a helical configuration.

10. A self-contained breathing apparatus, comprising:

an air tank;

a pressure regulator;

a mask; and hoses interconnecting said air tank, said pressure regulator and said mask to supply said mask with air from said air tank regulated by said pressure regulator, wherein said tank includes a hollow cylinder for containing gas and having an opening adapted for connection to one of said hoses, the cylinder having a center axis and having a sidewall with an inner surface defining the interior of the hollow cylinder, the hollow cylinder being formed from a non-conductive material, and wherein said tank includes an antenna formed from a helical coil of wire wound around said center axis and disposed within said sidewall.

11. The self-contained breathing apparatus claimed in claim 10, further comprising a magneto-inductive device for conducting magneto-inductive communications using said antenna, said magneto-inductive device including a power supply, a controller, and a magneto-inductive transceiver, wherein said transceiver is adapted for connection to said antenna to receive signals induced in said antenna and to generate signals within said antenna.

12. The self-contained breathing apparatus claimed in claim 11, wherein said magneto-inductive transceiver includes an antenna port for connecting with said antenna, and wherein said coil of wire includes ends co-located at an exterior surface of said tank and configured as an antenna connector for connection to said antenna port.

13. The self-contained breathing apparatus claimed in claim 10, wherein said sidewall includes an outer surface defining an exterior side of said cylinder, and wherein the antenna is embedded within said sidewall between said inner surface and said outer surface.

14. The self-contained breathing apparatus claimed in claim 10, wherein at least a portion of said inner surface includes a layer of magnetically permeable material.

15. The self-contained breathing apparatus claimed in claim 14, wherein said magnetically permeable material comprises a ferrite or magnetic alloy.

16. The self-contained breathing apparatus claimed in claim 10, wherein said sidewall comprises a first inner sidewall around which said antenna is wound during manufacture, and a second outer sidewall molded around said antenna and bonded to said inner sidewall.

17. The self-contained breathing apparatus claimed in claim 10, wherein said antenna is formed by said coil of wire in a helical configuration and said sidewall is formed by molding said non-conducive material around said antenna.

18. The self-contained breathing apparatus claimed in claim 10, wherein said non-conductive material comprises fibre-reinforced plastic.

* * * * *